United States Patent [19]

Grossman et al.

[11] Patent Number: 4,855,635

[45] Date of Patent: Aug. 8, 1989

[54] FLUORESCENT LAMP UNIT WITH MAGNETIC FIELD GENERATING MEANS

[75] Inventors: Mark W. Grossman, Belmont; William A. George, Rockport, both of Mass.

[73] Assignee: GTE Products Corporation, Danvers, Mass.

[21] Appl. No.: 172,940

[22] Filed: Mar. 22, 1988

Related U.S. Application Data

[63] Continuation of Ser. No. 830,153, Feb. 18, 1986, abandoned.

[51] Int. Cl.[4] ..... H01J 1/88

[52] U.S. Cl. ..... 313/156; 313/161

[58] Field of Search ..... 313/493, 610, 156, 160, 313/161; 315/56, 57, 70

[56] References Cited

U.S. PATENT DOCUMENTS

| | | | |
|---|---|---|---|
| 4,177,401 | 12/1979 | Yamane et al. | 313/610 |
| 4,187,446 | 2/1980 | Gross et al. | 315/58 |
| 4,300,073 | 11/1981 | Skwirut et al. | 315/53 |
| 4,311,942 | 1/1982 | Skeist et al. | 315/62 |
| 4,311,943 | 1/1982 | Gross et al. | 315/70 |
| 4,347,460 | 8/1982 | Latassa et al. | 315/63 |
| 4,375,607 | 3/1983 | Morton et al. | 315/56 |
| 4,383,200 | 5/1983 | Van Zon et al. | 315/57 |
| 4,389,595 | 6/1983 | Kamei et al. | 315/57 |
| 4,417,172 | 11/1983 | Touhou et al. | 313/156 |
| 4,434,385 | 2/1984 | Touhou et al. | 313/161 |

FOREIGN PATENT DOCUMENTS

| | | |
|---|---|---|
| 0066855 | 12/1982 | European Pat. Off. . |
| 60-60862 | 4/1985 | Japan . |

*Primary Examiner*—Robert L. Griffin
*Assistant Examiner*—T. Salindong
*Attorney, Agent, or Firm*—Carlo S. Bessone

[57] ABSTRACT

A fluorescent lamp unit having a magnetic field generating means for improving the performance of the fluorescent lamp is disclosed. In a preferred embodiment the fluorescent lamp comprises four longitudinally extending leg portions disposed in substantially quadrangular columnar array and joined by three generally U-shaped portions disposed in different planes. In another embodiment of the invention the magnetic field generating means comprises a plurality of permanent magnets secured together to form a single columnar structure disposed within a centrally located region defined by the shape of lamp envelope.

10 Claims, 4 Drawing Sheets

FLUORESCENT LAMP UNIT WITH MAGNETIC FIELD GENERATING MEANS

The Government has rights in this invention pursuant to Contract No. DE-AC03-76SF00098 awarded by the U.S. Department of Energy.

This application is a continuation of application Ser. No. 830,153, filed Feb. 18, 1986, now abandoned.

TECHNICAL FIELD

This invention relates to a fluoroscent lamp unit and, more particularly, a fluorescent lamp unit having a magnetic field generating means attached thereto for improving the performance of the fluorescent lamp.

BACKGROUND OF THE INVENTION

A fluorescent lamp unit which can be used in place of an incandescent lamp has become popular these days. The fluorescent lamp unit of this type has a screw base which can be fitted into the incandescent lamp socket, and when the screw base is connected to the socket, the fluorescent lamp unit can be used in the same manner as the incandescent lamp.

Magnetic fields have been used in the past with both compact fluorescent lamps for use with incandescent fixtures as well as conventional and non-conventional fluorescent lamps. For example, U.S. Pat. No. 4,187,446, which issued to Gross et al on Feb. 5, 1980 and U.S. Pat. No. 4,311,942, which issued to Skeist et al on Jan. 19, 1982 disclose the use of an electromagnetic field generated by a specially designed ballast to spread the arc periodically throughout the volume of a compact fluorescent lamp.

U.S. Pat. No. 4,311,943, which issued to Gross et al on Jan. 19, 1982, combines the use of a recombination structure of fine fibers interposed in the arc path with an arc spreading coil which serves as all or part of the ballast of the fluorescent lamp.

U.S. Pat. No. 4,417,172, which issued to Touhou et al on Nov. 22, 1983, relates to suppressing low temperature flickering phenomena caused by moving striation in conventional fluorescent lamps by means of electromagnets or permanent magnets.

U.S. Pat. No. 4,434,385, which issued to Touhou et al on Feb. 28, 1984, suggests the use of a magnetic field locally disposed around a non-conventional lamp for varying the light distributing direction and/or color of the lamp.

The use of permanent magnets in compact fluorescent lamp unit designs of the present invention can make effective use of the available magnetic flux without requiring substantial changes in ballast design. The permanent magnetic flux available is constant during the entire lamp operating cycle thus providing a magnetic field even when the lamp current passes through zero. The ballast field is approximately 90 degrees out of phase with the current and light output, B is proportional to di/dt, thus the maximum ballast magnetic field occurs near zero light output which may not be optimum. Furthermore, practical ballast fields are of the order of 20 to 40 gauss whereas permanent magnets of several hundred gauss are easily obtainable. Additionally, generation of many ballast fields via coil windings may not be compatible with certain advanced ballast designs.

SUMMARY OF THE INVENTION

It is, therefore, an object of the invention to obviate the disadvantages of the prior art.

It is another object of the invention to provide a compact fluorescent lamp unit.

Still another object of the invention is to provide a compact fluorescent lamp unit that is efficient to operate and economical to fabricate.

These objects are accomplished, in one aspect of the invention, by provision of a fluorescent lamp unit comprising a housing having a base means projecting from a first end thereof and a fluorescent lamp projecting from a second end of the housing and comprising a tubular envelope of light-transmitting vitreous material containing an ionizable medium. The envelope contains at least two leg portions joined together by a generally U-shaped portion. A pair of electrodes is respectively sealed at the ends of the envelope and a pair of electrical contact means connect the pair of electrodes. The envelope is configured to define a centrally located region extending longitudinally from the second end of the housing. In one embodiment, a circuit means is located within the housing electrically connecting the base and the electrical contact means for starting and operating the fluorescent lamp. Magnetic field generating means is disposed independently within the centrally located region defined by the envelope and spacedly located therefrom and extends longitudinally from the second end of the housing. The magnetic field generating means forms a single columnar structure for applying a constant non-time-varying transverse magnetic field over a portion of positive column induced in the fluorescent lamp to improve the performance of the fluorescent lamp. Preferably, the magnetic field generating means comprises at least one permanent magnet.

In accordance with further aspects of the present invention, the magnetic field generating means comprises a plurality of permanent magnets secured together to form a single columnar structure.

In accordance with still further aspects of the present invention, the external surface of the magnetic field generating means is preferably coated with a white colored light reflecting material.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
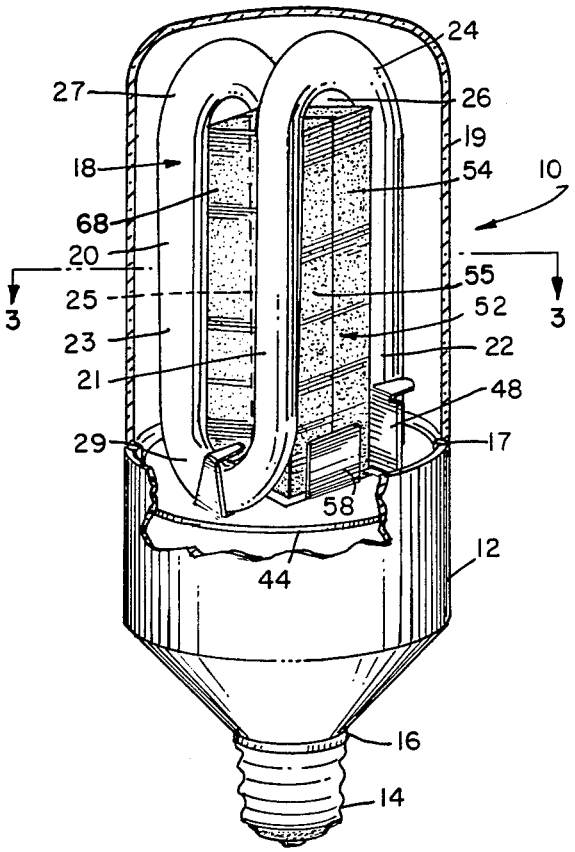
FIG. 1 is a partly broken away, perspective view of an embodiment of a fluorescent lamp unit according to the invention.

Referring now to the drawings with greater particularity, there is shown in FIG. 1 a fluorescent lamp unit 10 for use with an incandescent fixture comprising a housing 12 having a base means 14 (e.g., a screw-in incandescent-type base) projecting from a first end 16 of housing 12. A fluorescent lamp 18 projects from a second end 17 of housing 12. A protective cover 19 made of, for example, glass or polycarbonate resin may enclose fluorescent lamp 18. Fluorescent lamp 18 comprises a sealed tubular envelope 20 of light-transmitting vitreous material and contains an ionizable medium. Envelope 20 is formed to contain at least two substantially straight leg portions 21, 22 joined together by a generally U-shaped portion 24. Preferably, as shown in FIG. 1, envelope 20 contains four substantially straight longitudinally extending leg portions 21, 22, 23, 25 disposed in substantially quadrangular columnar array and joined by three generally U-shaped portions 24, 27, 29 disposed in different planes. Fluorescent lamp 18 is commonly referred to as a triple-U-bent or folded U-shaped lamp. An example of this lamp type is shown, for example, in U.S. Pat. No. 4,347,460, which issued to Latassa et al on Aug. 31, 1982 and is assigned to the assignee of the present application. Envelope 20 is configured so as to define a centrally located region 26 generally between the leg portions and extending longitudinally from second end 17 of housing 12.

Figure 2:
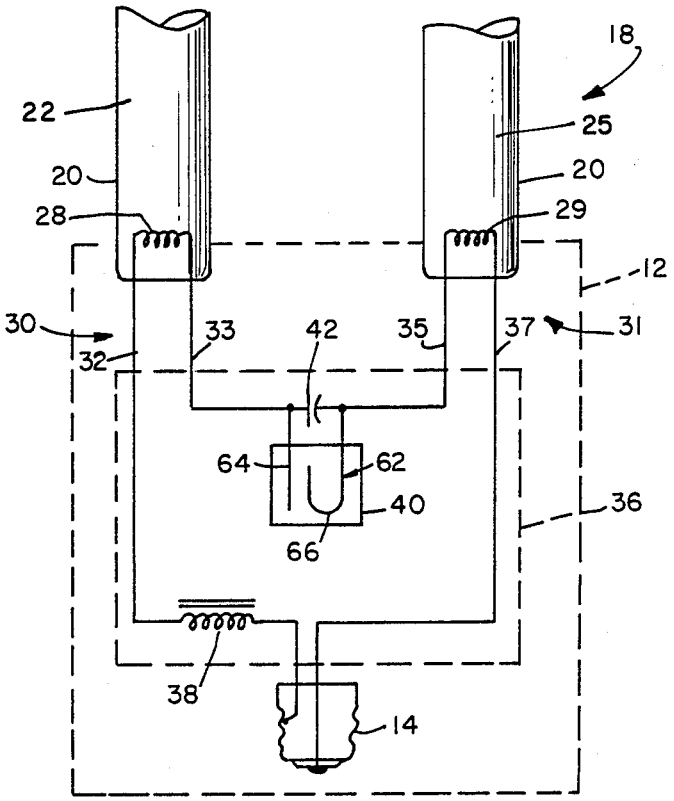
FIG. 2 is a circuit diagram of an embodiment according to the invention.

As shown in FIG. 2, fluorescent lamp 18 further includes a pair of electrodes 28, 29 respectively sealed at the ends of envelope 20. A pair of electrical contact means 30, 31 such as lead-in wires 32, 33 and 35, 37 or metal base pins (not shown) respectively connect the pair of electrodes 28, 29. A phosphor layer (not shown) which converts the ultraviolet radiation generated in the discharge into visible light, is present on the inner surface of envelope 20.

In one embodiment of the invention circuit means 36, electrically connecting base means 14 and lead-in wires 32, 33, 35, 37 for starting and operating fluorescent lamp 18, is located within housing 12. Circuit means 36 can be a standard preheat type circuit comprising a reactance ballast 38 connecting base means 14 to electrode 28 through lead-in wire 32 and a glow discharge starter 40 and associated radio frequency suppression capacitor 42 connecting lead-in wires 33, 35 of fluorescent lamp 18. Lead-in wire 37 electrically connects base means 14 to electrode 29. Glow discharge starter 40 contains at least one bimetallic electrode 62 and a counter electrode 64. Bimetallic electrode 62 comprises a U-shaped bimetallic element 66 which, when heated as a result of the glow discharge, bends towards counter electrode 64. When contact is broken, a voltage pulse induced by the induction of reactance ballast 38, appears across the opposed electrodes 28, 29 of fluorescent lamp 18 thereby initiating an arc discharge within the lamp. If lamp ignition does not occur after the first voltage pulse, the sequence of glow discharge starter 40 is repeated until lamp ignition occurs. Glow discharge starter 40 (and capacitor 42) and/or reactance ballast 38 can be located remote from housing 12.

Alternatively, circuit means 36 can also be made in the form of a solid-state ballast preferably located within housing 12 for starting and operating fluorescent lamp 18. A solid-state ballast can be used to reduce the weight of the lamp unit.

Figure 3:
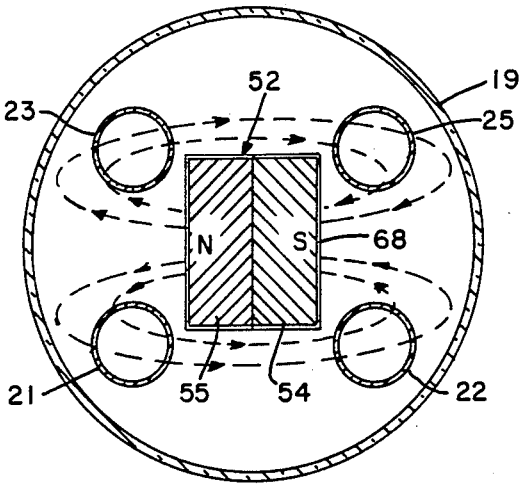
FIG. 3 is a cross-sectional view taken along the line 3—3 of the fluorescent lamp unit in FIG. 1.

In accordance with the invention and as shown in FIGS. 1 and 3, fluorescent lamp unit 10 further comprises magnetic field generating means 52 disposed independently within centrally located region 26 which is defined by envelope 20 generally between leg portions 21, 22, 23, 25 and extending longitudinally from second end 17 of housing 12. Magnetic field generating means 52 applies a constant non-time-varying transverse magnetic field over a portion of positive column induced in fluorescent lamp 18 to improve the performance of the lamp. As shown in FIG. 3, magnetic field generating means 52 is magnetized in a direction transverse to the discharge lamp. The performance of the lamp is improved when the light output and/or the lamp efficacy is increased. Preferably, as best shown in FIG. 1 magnetic field generating means 52 is configured such that the magnetic field is applied over substantially the entire length of positive column.

In a preferred embodiment, magnetic field generating means 52 comprises at least one permanent magnet 54. A plurality of permanent magnets 54, 55 can be secured together, for example, by means of epoxy to form a single columnar structure. As best shown in FIG. 3, substantially surrounding the magnets with the lamp, i.e., by locating the permanent magnets 54, 55 within the centrally located region defined by the envelope permits the more effective use of the available magnetic flux. This is in sharp contrast, for example, to affixing a similar permanent magnet along the surface of a linear fluorescent lamp. In the latter arrangement, at least 50 percent of the magnetic field flux is not being utilized.

Figure 4:
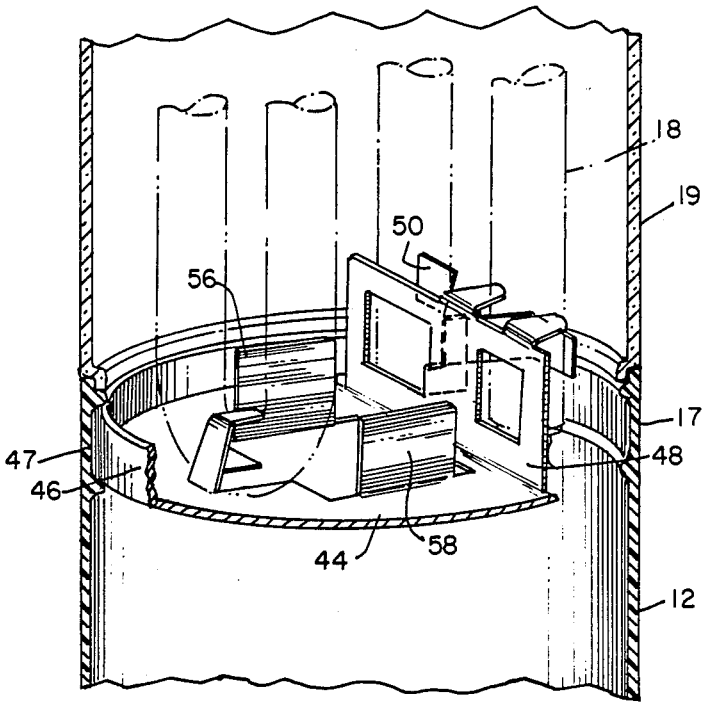
FIG. 4 is an enlarged, perspective view of a portion of the fluorescent lamp unit of FIG. 1.

Near the second end 17 of housing 12, as best shown in FIG. 4, there is a generally circular aluminum plate 44, which extends substantially to the outside of housing 12. On a portion of its circumference, the metal plate 44 has a raised edge 46 which engages the internal surface 47 of housing 12, locking metal plate 44 in place. Lamp 18 is rigidly held against a first upright wall 48 by means of a metal clip 50. Circular aluminum plate 44 has a second and third upright wall 56, 58 which rigidly engage magnetic field generating means 52.

As shown in FIG. 1, to further increase the light output from fluorescent lamp unit 10, the external surfaces of magnetic field generating means 52 exposed to the light from fluorescent lamp 18 are coated with a light reflecting material 68, such as white paint or enamel. Light-reflecting material 68 reduces the amount of light absorption from magnetic field generating means 52.

EXAMPLE I

In a practical embodiment of the above-described lamp unit, the overall length of fluorescent lamp 18 was approximately 36 centimeters; the inside diameter was approximately 10 millimeters. Circular aluminum plate 44 had a diameter of approximately 6.5 centimeters and a thickness of approximately 0.8 millimeters. Lamp 18 was connected to a standard preheat circuit comprising a reactance ballast, glow discharge starter and capacitor.

Four permanent magnets were placed together to form a single columnar structure having a longitudinally measured height of approximately 10.06 centimeters (3.96 inches), a width of approximately 2.54 centimeters (1.00 inch) and a depth of approximately 2.03 centimeters (0.80 inch). The permanent magnets used were Indox (registered trademark) ceramic magnets No. F-5601, available from Permag Northeast Corporation, Billerica, Mass. Each of the magnets had a weight of approximately 5.03 centimeters (1.98 inches), a width of approximately 2.54 centimeters (1.00 inch) and a depth of approximately 1.02 centimeters (0.40 inch) and weighed approximately 65.32 grams (0.144 pound). The near surface field strength is about 1000 gauss falling off to about 200 gauss over most of the positive column.

The external surfaces of the magnets were spray painted white.

Using an input voltage to the lamp unit of approximately 220 volts, 60 cycles alternating current, electrical and photometric data was obtained with and without the permanent magnets. Three separate reactances were chosen to produce the same arc current, arc wattage and lumen output, respectively, equivalent to the control (i.e., no permanent magnets) lamp unit. The effect of the permanent magnets on the performance of the fluorescent lamp operating in an ambient temperature of 77° (25° C.) on a preheat reactance ballast circuit is shown in Table I.

TABLE I

| | Control (no permanent magnets) | Four permanent magnets | | |
|---|---|---|---|---|
| | | Equivalent arc current | Equivalent arc wattage | Equivalent lumen output |
| Lumen Output (lumens) | 921 | 1019 | 976 | 921 |
| Arc Voltage (volts) | 92.50 | 102.60 | 123.20 | 127.00 |
| Arc Wattage (watts) | 15.11 | 16.68 | 15.11 | 14.36 |
| Arc Current (milliamps) | 200 | 200 | 149 | 137 |
| Lamp Efficacy (lumen per watts) | 60.95 | 61.09 | 64.59 | 64.14 |

Table I above shows the improvement in lamp performance employing the permanent magnets in a fluorescent lamp unit according to the invention compared to a fluorescent lamp unit without permanent magnets. At the same arc current of 200 milliamps as the control unit, the light output in the fluorescent lamp unit employing the four permanent magnets increased by approximately 10.6 percent. For an equivalent arc wattage, the light output (and efficacy) increased by approximately 5.97 percent. Alternatively, for an equivalent lumen output, the wattage decreased by approximately 4.96 percent while the efficacy increased by approximately 5.23 percent.

EXAMPLE II

In another practical embodiment according to the teachings of the invention, the overall length of fluorescent lamp 18 was approximately 36 centimeters; the inside diameter was approximately 10 millimeters. Lamp 18 was connected to a solid-state ballast, similar in construction to that found in a commercially available SL-18 lamp unit manufactured by Philips Corporation.

Two permanent magnets were placed together to form a single columnar structure having a longitudinally measured height of approximately 5.03 centimeters (1.98 inches), a width of approximately 2.54 centimeters (1.00 inch) and a depth of approximately 2.03 centimeters (0.80 inch). The permanent magnets used were Indox (registerd trademark) ceramic magnets No. F-5601, available from Permag Northeast Corporation, Billerica, Mass. Each of the magnets had a height of approximately 5.03 centimeters (1.98 inches), a width of approximately 2.54 centimeters (1.00 inch) and a depth of approximately 1.03 centimeters (0.40 inch) and weighed approximately 65.32 grams (0.144 pound). The near surface field strength is about 1000 gauss falling off to about 200 gauss over most of the positive column. The external surfaces of the permanent magnets were spray painted white. Identically shaped and painted aluminum blocks were also used in a separate test in order to determine the geometric shadowing effect (i.e., the amount of light output loss or absorption as a result of the shape, surface texture and color of an object placed approximate the lamp).

The effect of the permanent magnets on the performance of the fluorescent lamp unit operating in an ambient temperature of 77° F. (25° C.) on a 120 volt, 60 cycle input solid-state ballast is shown in Table II.

TABLE II

| | Control (no permanent magnets) | Two permanent magnets | Aluminum blocks |
|---|---|---|---|
| Lumen Output (lumens) | 1080 | 1138 | 979 |
| Input Wattage (watts) | 18.25 | 19.50 | 18.02 |
| Input Current (milliamps) | 244.80 | 259.20 | 242.30 |
| Unit Efficiency (lumen per watt) | 59.18 | 58.35 | 54.33 |

Table II shows the improvement in lamp performance employing the permanent magnets in a fluorescent lamp unit using a solid-state type ballast. The two permanent magnets significantly increased the lumen output approximately 5.37 percent even though shadowing effects initially decrease the lumen output by 9.35 percent.

While there have been shown and described what are at present considered to be the preferred embodiments of the invention, it will be apparent to those skilled in the art that various changes and modifications can be made herein without departing from the scope of the invention as defined by the appended claims. For example, although the invention is shown with a screw-type base, it is clear that the base could be of another type. Also, it is within the scope of the invention to have the circuit means for starting and operating the lamp either partially or completely located remote from the lamp, e.g., within the fixture or within an adapter unit.

We claim:

1. A fluorescent lamp unit comprising:

a housing having a base means projecting from a first end thereof;

a fluorescent lamp projecting from a second end of said housing comprising a sealed tubular envelope of light-transmitting vitreous material containing an ionizable medium and having at least two leg portions joined together by a generally U-shaped portion, a pair of electrodes respectively sealed at the ends of said envelope, and a pair of electrical contact means respectively connected to said pair of electrodes, said envelope being configured to define a centrally located region extending longitudinally from said second end of said housing; and magnetic field generating means disposed independently within said centrally located region defined by said envelope and spacedly located therefrom and extending longitudinally from said second end of said housing, said magnetic field generating means forming a single columnar structure disposed within said centrally located region magnetized in a direction transverse to the axial direction of said discharge lamp so as to apply a constant non-time-varying transverse magnetic field over substantially the entire length of positive column induced in said fluorescent lamp to improve the performance of said fluorescent lamp.

2. The fluorescent lamp unit of claim 1 wherein said magnetic field generating means comprises at least one permanent magnet.

3. The fluorescent lamp unit of claim 1 wherein said magnetic field generating means comprises a plurality of permanent magnets secured together to form said single columnar structure.

4. The fluorescent lamp unit of claim 1 wherein the external surface of said magnetic field generating means is coated with a light reflecting material.

5. The fluorescent lamp unit of claim 4 wherein said light reflecting material is white in color.

6. The fluorescent lamp unit of claim 1 wherein said envelope of said fluorescent lamp contains four longitudinally extending leg portions disposed in substantially quadrangular columnar array and joined by three generally U-shaped portions being disposed in different planes.

7. The fluorescent lamp unit of claim 1 further including circuit means for starting and operating said fluorescent lamp.

8. The fluorescent lamp unit of claim 7 wherein said circuit means is located within said housing and electrically connects said base means to said electrical contact means.

9. The fluorescent lamp unit of claim 7 wherein said circuit means includes a reactance ballast, glow discharge starter and capacitor.

10. The fluorescent lamp unit of claim 7 wherein said circuit means is a solid-state ballast.

* * * * *